US005566729A

United States Patent [19]

Grabenkort et al.

[11] Patent Number: 5,566,729

[45] Date of Patent: Oct. 22, 1996

[54] DRUG RECONSTITUTION AND ADMINISTRATION SYSTEM

[75] Inventors: Richard W. Grabenkort, Barrington; John C. Tanner, II, Lake Bluff; Sheldon M. Wecker, Libertyville, all of Ill.

[73] Assignee: Abbott Laboratories, Abbott Park, Ill.

[21] Appl. No.: 417,575

[22] Filed: Apr. 6, 1995

[51] Int. Cl.[6] ..... B65B 1/04; B65B 3/04; B65B 31/00

[52] U.S. Cl. ..... 141/25; 141/26; 141/27; 141/318; 141/319; 141/351; 141/357; 141/370; 141/383; 604/416; 604/905

[58] Field of Search ..... 141/25, 26, 27, 141/318–322, 325, 326, 351, 352, 357, 369, 370, 375, 383, 384; 604/403, 407, 416, 903, 905

[56] References Cited

U.S. PATENT DOCUMENTS 4,576,211 3/1986 Valentini et al. ..... 604/905
5,064,059 11/1991 Ziegler et al. ..... 604/416
5,088,996 2/1992 Kopfer et al. ..... 604/416
5,356,380 10/1994 Hoekwater et al. ..... 604/905

*Primary Examiner*—Henry J. Recla
*Assistant Examiner*—Timothy L. Maust
*Attorney, Agent, or Firm*—Brian R. Woodworth

[57] ABSTRACT

A drug reconstitution and administration system includes a container for a concentrated drug or other medicament, a syringe assembly which can be pre-filled with a liquid diluent, and a mixing adapter assembly which facilitates mixing of the medicament with the liquid diluent. The adapter assembly includes inner and outer concentrically arranged, relatively movable sleeves, which together define an expandable mixing chamber within the adapter assembly. The container and pre-filled syringe are respectively fitted to the adapter assembly, with the contents of the container and the contents of the syringe transferred into the internal mixing chamber. A diluted drug mixture is formed in the mixing chamber, and the mixture is transferred into the syringe assembly for subsequent patient administration.

13 Claims, 4 Drawing Sheets

FIG. 3
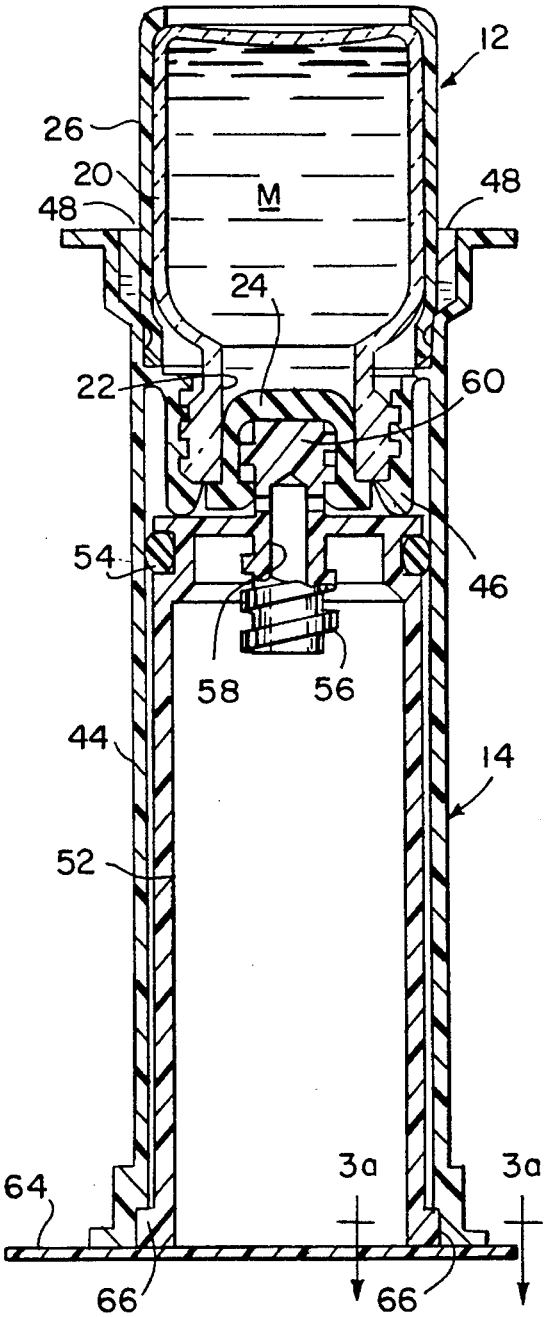
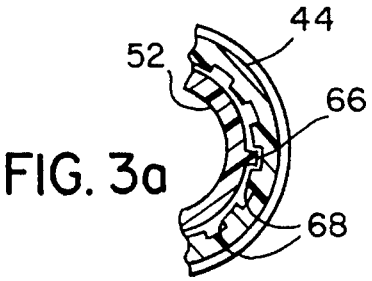
FIG. 3a
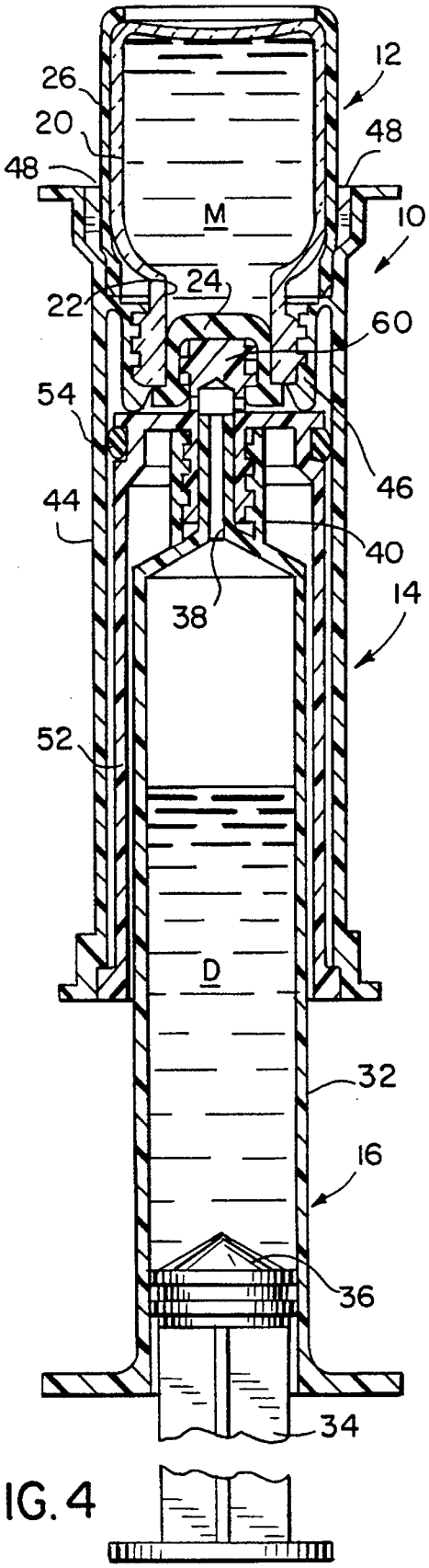
FIG. 4

DRUG RECONSTITUTION AND ADMINISTRATION SYSTEM

TECHNICAL FIELD

The present invention relates generally to medical devices for the preparation and administration of therapeutic compounds, and more particularly to a drug reconstitution and administration system which facilitates reconstitution and dilution of a drug with a liquid diluent, and subsequent administration of the resultant mixture from a syringe assembly of the system.

BACKGROUND OF THE INVENTION

Because of the very large number of drugs and other medicaments which must be routinely prepared and administered to patients in a healthcare facility, it is desirable to provide such compounds in containers and like devices which promote efficient storage, preparation, and administration. To this end, one such packaging system, marketed under the tradename ADD-VANTAGE® by Abbott Laboratories, Abbott Park, Ill., promotes such efficiency by providing drugs and other compositions in concentrated forms in vial-like containers which are especially configured to fit with associated components for the preparation and dilution of the compositions for subsequent administration.

The present system is configured to facilitate the preparation and administration of concentrated medicaments in a reliable, consistent, and cost-effective manner.

SUMMARY OF THE INVENTION

The present drug reconstitution and administration system is a multi-component arrangement which permits a concentrated drug or other composition to be mixed with a liquid diluent from a pre-filled syringe assembly, with the system further permitting the syringe assembly to be refilled with the resultant mixture for patient administration. The system permits drugs to be efficiently stored and handled in concentrated form, and further facilitates dilution of the drugs to the desired concentration just prior to administration through the use of the integrated components of the system.

In accordance with the illustrated embodiment, the present system includes a container for containing a drug or other medicament, with the container having an open mouth, and a removable stopper for closing the mouth. A thread formation is preferably provided generally at the mouth of the container for use in the present system.

The system further includes a syringe assembly including a generally cylindrical barrel having an open end, and a generally closed end defining a flow passage. The syringe assembly includes a plunger slidably positioned in the barrel and extending from the open end thereof. The plunger defines with the barrel an internal chamber in fluid communication with the flow passage so that liquid can be moved into and out of the internal chamber via the flow passage.

The present system further includes a mixing adapter assembly for mixing a liquid in the syringe assembly with a medicament in the container. The adapter assembly includes a generally cylindrical outer sleeve having a thread formation at one end thereof for threaded connection with the thread formation of the associated container. By this arrangement, the mouth of the container, and the stopper positioned therein, can be positioned in one end of the outer sleeve of the adapter assembly.

The adapter assembly further includes a generally cylindrical inner sleeve slidably positioned in the outer sleeve in sealing engagement therewith. The inner sleeve has a generally closed end defining a flow port, and an opposite open end. The inner sleeve has an inside diameter larger than the outside diameter of the barrel of the associated syringe assembly, thus permitting the syringe assembly to be positioned generally telescopically within the outer sleeve during use of the system.

The inner sleeve of the adapter assembly defines, with the outer sleeve, an expandable mixing chamber within the outer sleeve, with the flow port of the inner sleeve being in fluid communication with the mixing chamber. Notably, the inner sleeve further includes a stopper removal element generally at the flow port thereof, which element is engageable with the stopper of the associated container when the container mouth is threadably connected with the outer sleeve of the adapter assembly.

The inner sleeve of the adapter assembly, and the barrel of the syringe assembly respectively comprise mating thread formations for detachably connecting the inner sleeve and the barrel to thereby connect the flow passage of the syringe assembly and the flow port of the inner sleeve in fluid communication with each other. By this arrangement, the present system permits reconstitution of a concentrated drug by positioning the syringe assembly generally within the open end of the inner sleeve with the components threadably connected to each other. In this configuration, a liquid, such as a diluent, in the internal chamber of the syringe assembly, can be caused to flow through the flow passage of the syringe assembly and through the flow port of the inner sleeve into the expandable mixing chamber of the mixing adapter assembly. As this occurs, the inner sleeve of the adapter assembly slides outwardly of the outer sleeve thereof to effect removal of the stopper from the associated container. The liquid from the syringe assembly is thus mixed with the medicament from the container within the expandable mixing chamber of the adapter assembly. The desired diluted drug mixture is thus provided within the now-expanded mixing chamber of the adapter assembly, with the now-empty container fitted at one end of the adapter assembly, and the now-empty syringe assembly fitted to the opposite end thereof.

When mixing is complete, the present system facilitates administration of the mixture by filling the syringe assembly with the mixture. The mixture is caused to flow from the mixing chamber into the internal chamber of the syringe assembly by movement of the inner sleeve of the adapter assembly inwardly of the outer sleeve. At the same time, the plunger of the syringe assembly is moved outwardly of the syringe barrel. Thus, the diluted drug mixture is transferred from the mixing chamber of the adapter assembly into the syringe assembly, so that the syringe assembly can be detached from the inner sleeve of the adapter assembly for subsequent patient administration of the mixture.

In the preferred form, the adapter assembly is provided in a closed form to maintain its sterility, such as by the preferred provision of a pair of peel-away seals or like closing elements positioned at respective opposite ends of the adapter assembly. The arrangement is preferably configured for single-use, and to this end, a locking arrangement is provided which prevents removal of the container from the adapter assembly after it has been threadably connected with the outer sleeve of the assembly.

Other features and advantages of the present invention will become readily apparent from the following detailed description, the accompanying drawings, and the appended claims.

BRIEF DESCRIPTION OF THE DRAWINGS

FIG. 3 is a cross-sectional view of the adapter assembly of FIG. 2 fitted with an associated container of the present system;

FIG. 3*a* is a fragmentary cross-sectional view taken along lines 3*a*—3*a* of FIG. 3;

FIG. 4 is a cross-sectional view further illustrating the present system, including the interconnected adapter assembly and container shown in FIG. 3, together with an interconnected syringe assembly of the present system;

DETAILED DESCRIPTION

Figure 1:
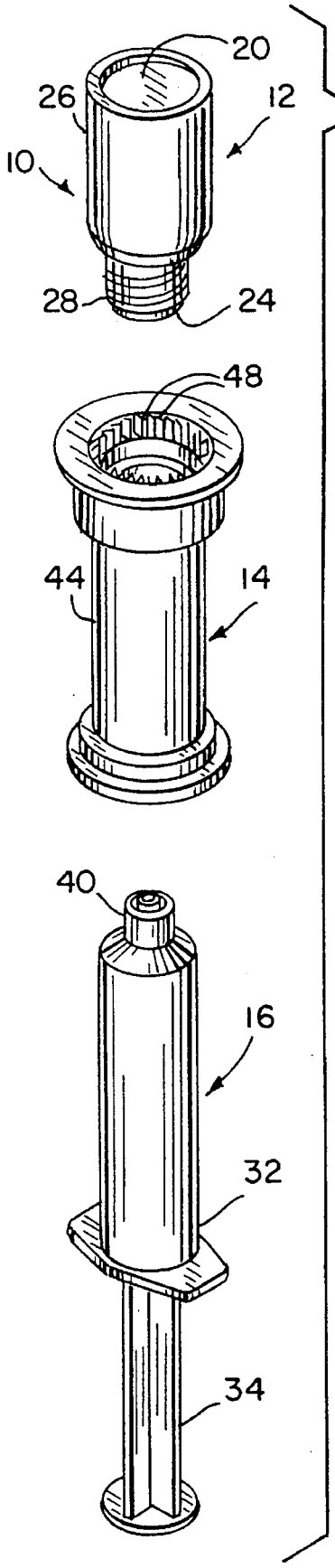
FIG. 1 is an exploded perspective view of a drug reconstitution and administration system embodying the principles of the present invention.
Figure 2:
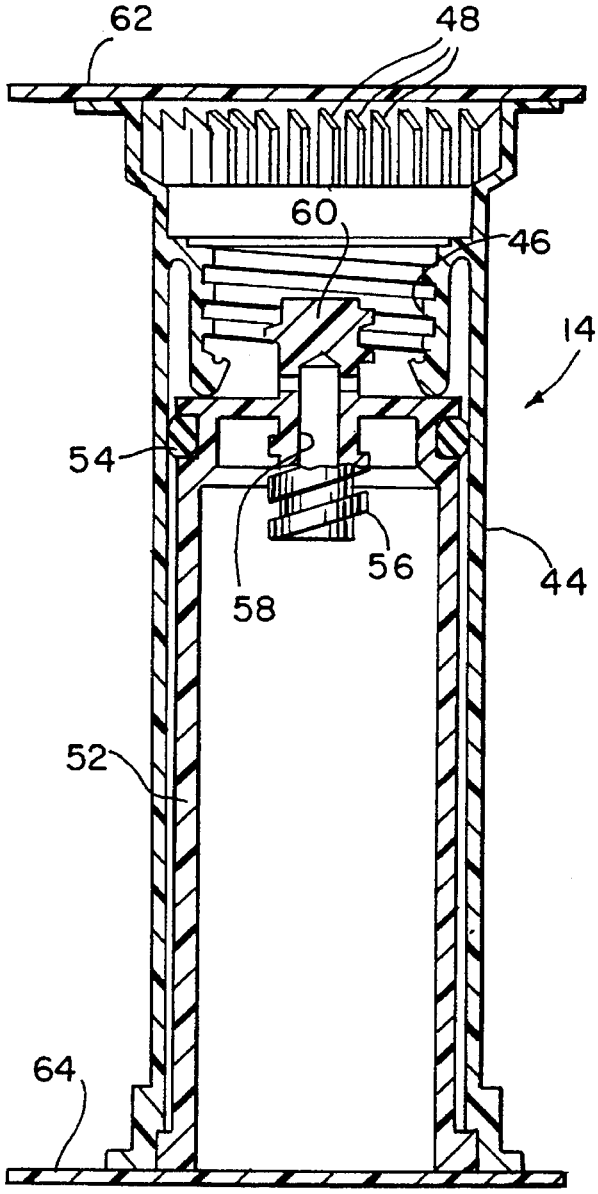
FIG. 2 is a cross-sectional view of an adapter assembly of the present system.

While the present invention is susceptible of embodiment in various forms, there is shown in the drawings and will hereinafter be described a presently preferred embodiment, with the understanding that the present disclosure is to be considered as an exemplification of the invention, and is not intended to limit the invention to the specific embodiment illustrated.

Referring first to FIG. 1, therein is illustrated a drug reconstitution and administration system 10 embodying the principles of the present invention. As will be further described, the present system includes a container, generally designated 12, holding a drug or other medicament M (FIG. 3), a mixing adapter assembly 14 for effecting dilution of medicament M, and a syringe assembly 16 which is filled with a liquid diluent D (FIG. 4) prior to use of the present system. In the illustrated embodiment, the system 10 is shown in the configuration to facilitate its use with the ADD-VANTAGE® packaged drugs available from Abbott Laboratories, Abbott Park, Ill., but as will be appreciated, the present system can readily be configured for use with other types of packaging arrangements.

The various components of the present system will now be described in detail. Container 12 preferably comprises a vial 20 formed from glass or other suitable material, and includes an open mouth 22 within which is positioned a removable elastomeric stopper 24. The vial 20 of the container is housed within a container casing 26 to protect the contents of the container, and to which may be affixed suitable labeling or the like. A thread formation 28 is provided generally at the open mouth of the container. A frangible, removable cap or cover (not shown) is ordinarily provided generally about the mouth of the container for preventing inadvertent removal of stopper 24.

Syringe assembly 16 of the system is generally conventional in configuration, and includes a generally cylindrical barrel 32 having an open end and a generally closed end. An internal plunger 34 is slidably, sealingly disposed within the barrel 32, with an elastomeric piston portion 36 of the plunger sealingly engaging the interior surface of the outer barrel. The plunger and the barrel together define an internal chamber in communication with a flow passage 38 defined by the generally closed end of the barrel 32. For use of the present system, the syringe assembly 16 is pre-filled with a liquid diluent D, such as a sterile saline solution, for subsequent mixture with the medicament M in the container 12 of the system.

Mixing of a medicament and diluent is accomplished within the mixing adapter assembly 14 of the present system. The adapter assembly is desirably straightforward in configuration for economical manufacture and convenient use, and generally comprises an arrangement of concentrically disposed, relatively slidable sleeves. Specifically, the adapter assembly includes an outer sleeve 44 having an internally threaded collar 46 at one end thereof which defines a thread formation configured for mating threaded engagement with the thread formation 28 on the container 12 of the system. Because the present system is preferably configured for single-use, the outer sleeve 44 is preferably provided with an arrangement which cooperates with the container 12 for preventing disconnection of the container from the outer sleeve after they are threadably joined with each others. Specifically, the outer sleeve 44 includes a plurality of circumferentially spaced locking teeth 48 which cooperate with suitable projections or surface irregularities on the casing 26 of container 12 to provide a one-way, ratchet-like cooperation between the locking teeth and the container. Thus, during assembly of the components of the system, the container 12 is inserted generally into the outer sleeve 44 of the adapter assembly so that the thread formation of the container is brought into threaded engagement with the internally threaded collar 46 of the outer sleeve. After the container is fully seated within the outer sleeve, in the orientation illustrated in FIG. 3, the cooperation of the locking teeth 48 with the container casing 26 substantially prevents unthreading of the thread formations by reverse, relative rotation of the container and outer sleeve.

The adapter assembly 14 further includes a generally cylindrical inner sleeve 52 slidably positioned within the outer sleeve 44 in a generally telescopic relationship therewith. The inner sleeve includes an annular seal element 54 disposed about a generally closed end of the inner sleeve, with the inner sleeve further including an integral threaded connector 56 at its closed end. A flow port 58 is defined by the generally closed end of the inner sleeve with the inner sleeve and outer sleeve together defining an expandable mixing chamber within which a mixture, MX (FIG. 6) is formed during use of the present system.

A feature of the present system which promotes its efficient and convenient use is the provision of a stopper removal means on the inner sleeve 52 generally adjacent the flow port 58. The removal means which can include a barb-like element 60 (as shown), a thread-like formation (not shown), or other suitable means, is configured for engagement with the removable stopper 24 of the container 12. In particular, the removable stopper 24 of the container 12 is urged into engagement with the removal barb 60 as the container 12 is rotatably inserted into the outer sleeve 44 of the adapter assembly, with the thread formation on the container threadably engaged with the thread formation on the threaded collar 46 of the outer sleeve. As best shown in FIG. 3, with the inner sleeve 52 positioned in its inwardly-most position with respect to the outer sleeve, the removal barb 60 becomes positioned and generally embedded within the removable stopper 24, with the container 12 locked against removal from this fully inserted position by the preferred provision of locking teeth 48. As will be appreciated, prior to interconnection of container 12 with the adapter assembly 14, one of two removable peel-seals 62, 64, respectively fitted to opposite ends of the adapter assembly is removed. The provision of peel-away seals 62, 64 is preferred for maintaining the sterility of the interior of the adapter assembly, but other suitable means for closing the ends of the adapter assembly 14 can be employed, such as removable cups or covers.

After insertion of container 12 into the adapter assembly 14, and its threaded connection with collar 46 of outer sleeve 44, the present system appears generally as illustrated in FIG. 3. Dilution of medicament M with liquid diluent D is next effected by removal of seal 64, and insertion of the pre-filled syringe assembly 16 into the inner sleeve of the relatively collapsed adapter assembly. As will be observed, the inside diameter of the inner sleeve 52 is larger than the outside diameter of the outer barrel 32 of the syringe assembly, so that the syringe assembly can be inserted into the adapter assembly into the position illustrated in FIG. 4. As will be observed, the internally threaded sleeve portion 40 of the syringe assembly is threadably joined to the threaded connector 56 of the inner sleeve thereby joining the flow passage 38 in fluid communication with the flow port 58 (FIG. 5) and, in effect, joining the internal chamber of the syringe assembly and the mixing chamber of the adapter assembly in fluid communication.

In order to assure that the syringe assembly 16 is properly threadably joined to the inner sleeve 52, an arrangement is preferably provided for preventing rotation of the inner sleeve relative to the outer sleeve 44 of the adapter assembly. In the illustrated embodiment, such relative rotation is prevented by the provision of one or more locking projections 66 on the outer periphery of the inner sleeve generally at the open end thereof. In a current embodiment, four such projections 66 are provided evenly spaced about the periphery of the inner sleeve. As shown in FIGS. 3 and 3*a*, locking projections 66 are each configured to engage and cooperate with a plurality of mating projections 68 provided on an inside surface of outer sleeve 44 of the adapter assembly. The projections 68 define a series of recesses for receiving the locking projections 66 on the inner sleeve when the inner sleeve is in its initial position, i.e., fully seated and telescoped within the outer sleeve, thereby preventing the relative rotation of the sleeves. Relative rotation of the inner and outer sleeves of the adapter assembly 14 is thus prevented during threading and unthreading of the barrel 32 of the syringe assembly and the inner sleeve 52 of the adapter assembly.

Figure 5:
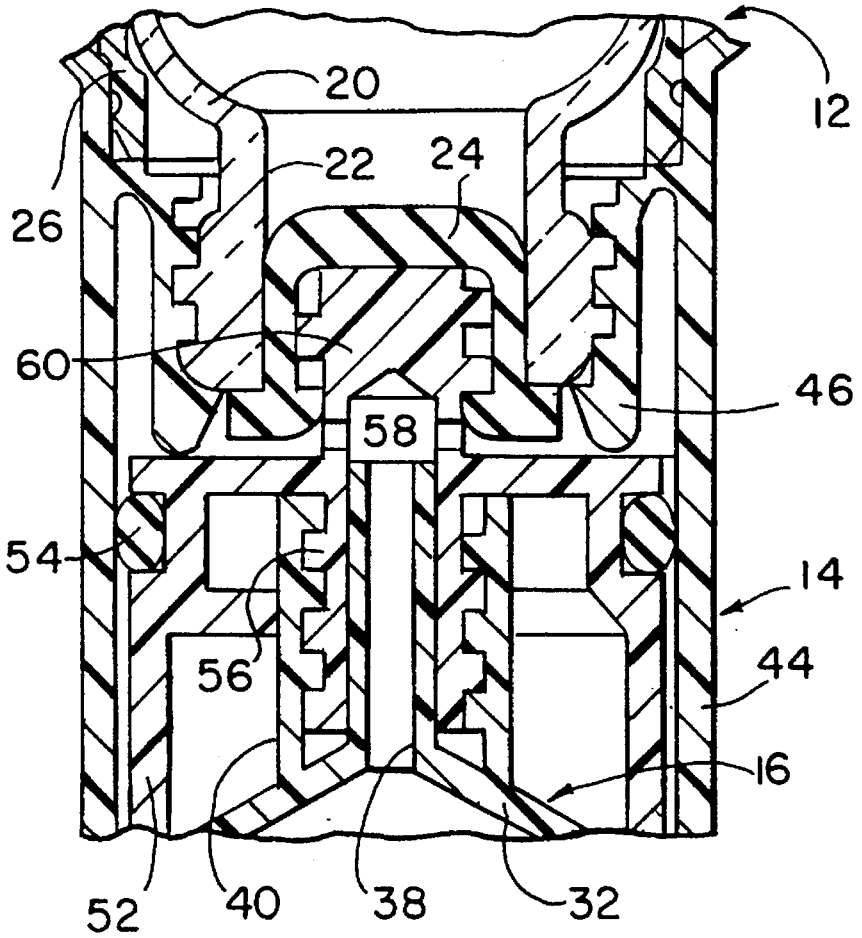
FIG. 5 is a fragmentary, relatively enlarged cross-sectional view further illustrating interconnection of the container, adapter assembly, and syringe assembly of the present system.

As will be observed in FIG. 5, the flow port 58 of the inner sleeve 52 is configured, relative to threaded collar 46, and internal stopper 24, such that the flow port is in fluid communication with the expandable mixing chamber of the adapter assembly after the removal barb 60 has fully seated within the removable stopper 24. As will be observed in FIG. 4, the pre-filled syringe assembly 16 is only partially filled with liquid diluent, since the syringe assembly will eventually be filled with a greater volume of the diluted drug mixture MX.

With the system 10 assembled as illustrated in FIG. 4, mixing and dilution of medicament M with liquid diluent D is ready to be effected. As the plunger 34 of the syringe assembly 16 is moved inwardly with respect to outer barrel 32,the contents of the syringe assembly are urged through flow passage 38 and flow port 58, and into the mixing chamber of the adapter assembly 14. The mixing chamber is expanded by and accommodates introduction of the contents of the syringe assembly into the mixing chamber, with this expansion effected by hydraulic pressure in the mixing chamber with the resultant outward movement of inner sleeve 52 relative to outer sleeve 44. As the inner sleeve moves outwardly of the outer sleeve, removal barb 60 firmly engages removable stopper 24, thereby withdrawing and removing the stopper 24 from the open mouth of the container 12. When the system is held in the generally vertical orientation illustrated in the drawings, the contents of container 12 can flow from container 12 into the expanding mixing chamber of the adapter assembly as the inner sleeve 52 moves outwardly with respect to the outer sleeve 44. The integrated nature of the components of the present system, including threaded connections between the container 12 and the adapter assembly 14, and between the adapter assembly and the syringe assembly 16, permits agitation (such as by shaking) to ensure complete mixing of the medicament on and in the diluent D.

Figure 6:
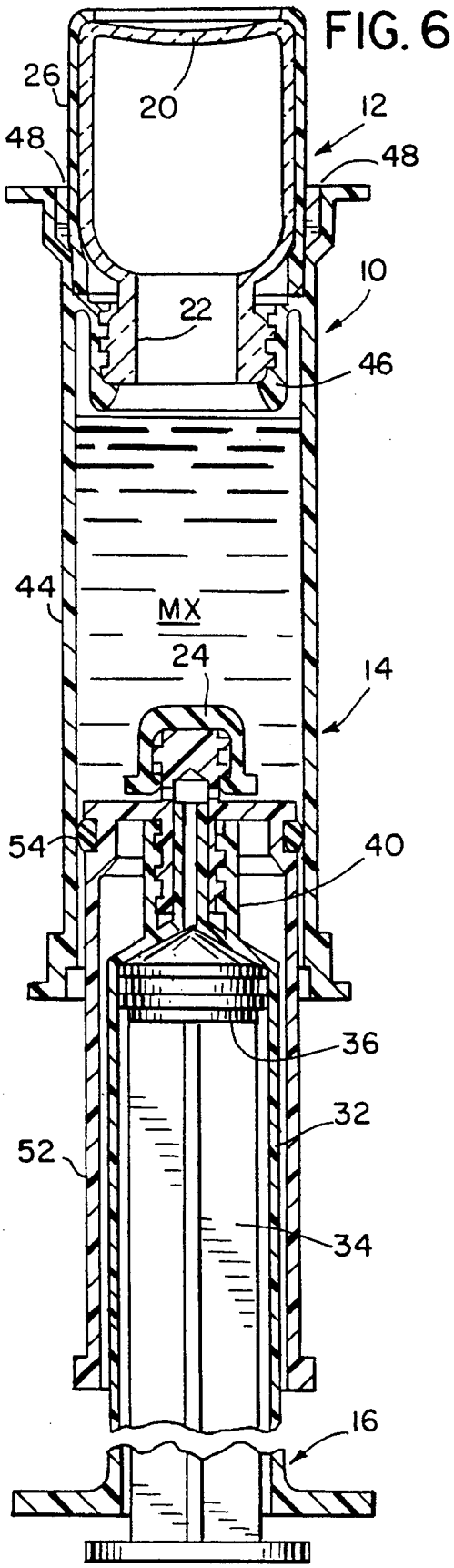
FIGS. 6 and 7 are views similar to FIG. 4, further illustrating use of the present system for drug reconstitution and administration.
Figure 7:
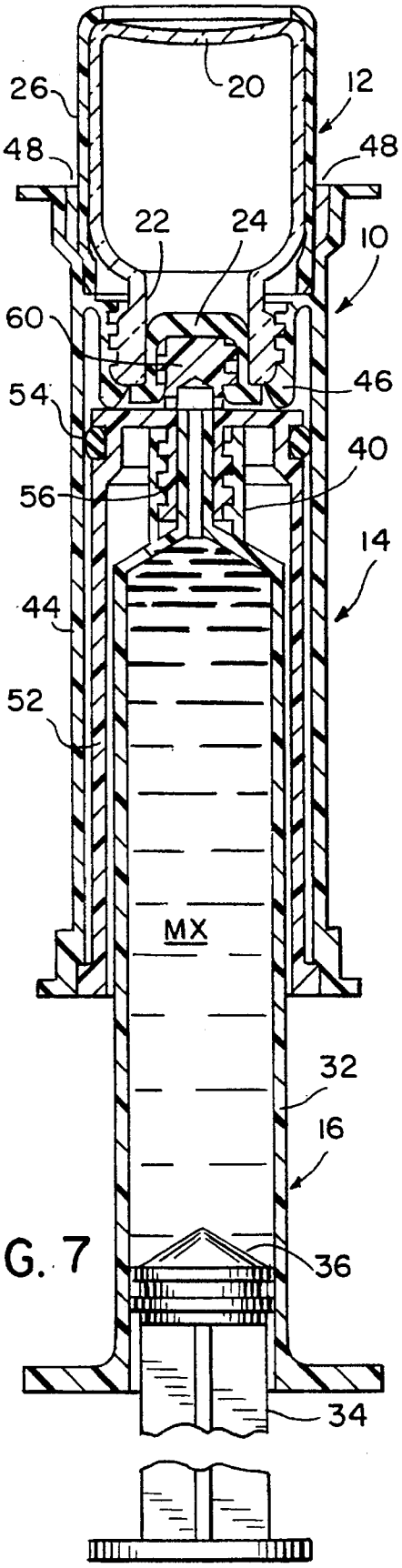

After the liquid diluent from the syringe assembly 16, and the medicament M from container 12, have been mixed to form mixture MX in the adapter assembly 14, as shown in FIG. 6, the reconstituted drug is now ready for patient administration. For this purpose, the components are positioned in the vial up orientation of FIG. 7, and the mixture is transferred back into the syringe assembly 16 by inward movement of the inner sleeve 52 (and the barrel 32) inwardly of outer sleeve 44, with the plunger 34 of the syringe assembly moving outwardly of the outer barrel 32. The mixture MX is thus caused to flow back through flow port 58 and flow passage 38 into the internal chamber of the syringe assembly. After this transfer has been completed, the expandable mixing chamber is substantially completely collapsed and the stopper 24 is reinserted into container 12. Syringe assembly 16 can then be relatively rotated with respect to the adapter assembly for unthreading the internally threaded sleeve portion 40 from the threaded connector 56 of inner sleeve 52. Again, locking projection 66 and mating projections 68 prevent relative rotation of inner sleeve 52 with respect to outer sleeve 44. The syringe assembly, filled with the reconstituted drug mixture MX, is now ready for use in administering the mixture to a patient.

From the foregoing, it will be observed that numerous modifications and variations can be effected without departing from the true spirit and scope of the novel concept of the present invention. It is to be understood that no limitation with respect to the specific embodiment illustrated herein is intended or should be inferred. The disclosure is intended to cover, by the appended claims, all such modifications as fall within the scope of the claims.

What is claimed is:

1. A drug reconstitution and administration system comprising:

a container, having a mouth, for containing a medicament;

a syringe assembly including a barrel having an open end and a generally closed end defining a flow passage, and a plunger slidably positioned in said barrel and extending from said open end, said plunger defining with said barrel an internal chamber in fluid communication with said flow passage; and a mixing adapter assembly for mixing a liquid in said syringe assembly with the medicament in said container, said adapter assembly including an outer sleeve for sealingly receiving the mouth of said container at one end thereof, and an inner sleeve slidably positioned within said outer sleeve and having a generally closed end defining a flow port and an open end, said inner sleeve being slidably movable relative to said outer sleeve to define therewith an expandable mixing chamber within said outer sleeve, said inner sleeve and said barrel of said syringe assembly respectively comprising connector means for detachably connecting said flow passage of said barrel with the flow port of said inner sleeve in fluid communication, so that said syringe assembly is positionable generally within the open end of said inner sleeve, and the liquid in said internal chamber of said syringe assembly can be caused to flow from said internal chamber, through said flow passage and said flow port, and into said mixing chamber as said inner sleeve slides outwardly of said outer sleeve so that the liquid can be mixed with medicament from said container to form a mixture, said mixture thereafter being caused to flow from said mixing chamber into said internal chamber of said syringe assembly by movement of said inner sleeve inwardly of said outer sleeve and movement of said plunger outwardly of said barrel for subsequent administration of said mixture from said syringe assembly after detachment of said barrel from said inner sleeve.

2. A drug reconstitution and administration system in accordance with claim 1, wherein said container includes a removable stopper for closing the mouth of said container, said inner sleeve including removal means engageable with said stopper for removing said stopper from said container as said inner sleeve moves outwardly of said outer sleeve of said adapter assembly.

3. A drug reconstitution and administration system in accordance with claim 2, wherein said outer sleeve and said container respectively comprise thread formations for threadably connecting said container to said outer sleeve.

4. A drug reconstitution and administration system in accordance with claim 3, wherein said connector means comprises mating threadable formations respectively provided on said barrel of said syringe assembly and said inner sleeve of said adapter assembly, said stopper being urged into engagement with said removal means of said inner sleeve as said container is threadably connected with said outer sleeve.

5. A drug reconstitution and administration system in accordance with claim 2, including means for preventing rotation of said inner sleeve relative to said outer sleeve during connection of said barrel of said syringe assembly to said inner sleeve.

6. A drug reconstitution and administration system in accordance with claim 2, wherein said adapter assembly includes removable means for closing opposite ends of said barrel of said adapter assembly prior to connection with said container and said syringe assembly.

7. A drug reconstitution and administration system in accordance with claim 1, wherein said inner sleeve of said adapter assembly includes an annular seal for slidably, sealingly engaging the inside of said outer sleeve of said adapter assembly.

8. A drug reconstitution and administration system comprising:

a container for containing a medicament having an open mouth, a thread formation generally at said mouth, and a removable stopper for closing said mouth;

a syringe assembly including a barrel having an open end and a generally closed end defining a flow passage, and a plunger slidably positioned in said barrel and extending from said open end, said plunger defining with said barrel an internal chamber in fluid communication with said flow passage; and a mixing adapter assembly for mixing a liquid in said syringe assembly with the medicament in said container, said adapter assembly including a generally cylindrical outer sleeve having a thread formation at one end thereof for threaded connection with the thread formation of said container so that said stopper and said container mouth can be positioned in said one end of said outer sleeve, said adapter assembly further including a generally cylindrical inner sleeve slidably positioned in said outer sleeve in sealing engagement therewith, said inner sleeve having a generally closed end defining a flow port and an open end, said inner sleeve having an inside diameter larger than an outside diameter of the barrel of said syringe assembly, said inner sleeve defining with said outer sleeve an expandable mixing chamber within said outer sleeve, said inner sleeve including removal means at said flow port engageable with said stopper of said container when said container mouth is threadably connected with said outer sleeve, said inner sleeve and said barrel of said syringe assembly respectively comprising mating thread formations for detachably connecting said inner sleeve and said barrel to connect said flow passage and said flow port in fluid communication, so that said syringe assembly is positionable generally within the open end of said inner sleeve and threadably connected thereto, and a liquid in said internal chamber of said syringe assembly can be caused to flow through said flow passage and said flow port into said expandable mixing chamber as the inner sleeve slides outwardly of said outer sleeve to effect removal of said stopper from said container so that the liquid can be mixed with medicament from said container to form a mixture, said mixture thereafter being caused to flow from said mixing chamber into said internal chamber of said syringe assembly by movement of said inner sleeve inwardly of said outer sleeve and movement of said plunger outwardly of said outer barrel for subsequent administration of said mixture from syringe assembly after detachment of said barrel from said inner sleeve.

9. A drug reconstitution and administration system in accordance with claim 8, wherein said outer sleeve includes locking means engageable with said container for locking said container against removal from said outer sleeve after said container has been threadably connected with said outer sleeve.

10. A drug reconstitution and administration system in accordance with claim 9, wherein said locking means comprises a plurality of locking teeth.

11. A drug reconstitution and administration system in accordance with claim 10, wherein said adapter assembly includes removable seal means for sealing opposite ends of said barrel prior to connection of said adapter assembly with said container and said syringe assembly.

12. A drug reconstitution and administration system in accordance with claim 8, including means for preventing rotation of said inner sleeve relative to said outer sleeve in a fully seated position of said inner sleeve within said outer sleeve during threaded connection of said barrel of said syringe assembly to said inner sleeve.

13. A drug reconstitution and administration system in accordance with claim 12, wherein said rotation preventing means comprises at least one locking projection on said inner sleeve engageable with a plurality of mating projections on said outer sleeve.

* * * * *